US006295040B1

(12) United States Patent
Nhan et al.

(10) Patent No.: US 6,295,040 B1
(45) Date of Patent: Sep. 25, 2001

(54) AC-TYPE PLASMA DISPLAY PANEL AND ITS DRIVING METHOD

(75) Inventors: Nguyen Thanh Nhan; Nobuyoshi Kondo, both of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 08/733,008

(22) Filed: Oct. 16, 1996

(30) Foreign Application Priority Data

Oct. 16, 1995 (JP) ..... 7-267153

(51) Int. Cl.[7] ..... G09G 3/28

(52) U.S. Cl. ..... 345/60; 345/67

(58) Field of Search ..... 345/55, 60, 61, 345/64, 66, 67, 68, 37, 76; 315/169.1, 169.4

(56) References Cited

U.S. PATENT DOCUMENTS 5,661,500 8/1997 Shinoda et al. ..... 345/60
5,835,072 * 10/1998 Kanazawa ..... 345/68

FOREIGN PATENT DOCUMENTS 4-92340 3/1992 (JP) .

* cited by examiner

*Primary Examiner*—Matthew Luu
(74) *Attorney, Agent, or Firm*—Staas & Halsey LLP

(57) ABSTRACT

In an AC-type PDP including first and second sustain electrodes extending along a line direction via a discharge slit; a discharge space; a dielectric layer coated on the first and second sustain electrodes, and an address electrode orthogonal to the first and second sustain electrodes via the dielectric layer, wherein the first and second sustain electrodes comprise first and second belt-like first and second metal electrodes thereon, respectively, where the first and second metal electrodes are narrower than the first and second transparent electrodes, respectively, wherein the first metal electrode is located on an edge apart from the discharge slit; and the second metal electrode is located on another edge near to the discharge slit. Moreover, then, a distance between the second sustain electrode and said address electrode may be smaller than a distance between said first sustain electrode and said address electrode. A gap between the second sustain electrode and the address electrode may be smaller than a clearance between the first sustain electrode and the address electrode. A rise time of a first sustain pulse which makes the second sustain electrodes negative with respect to the first sustain electrode is preferably slower than a second rise time of a second sustain pulse which makes the second sustain electrodes positive with respect to the first sustain electrode.

23 Claims, 12 Drawing Sheets

AC-TYPE PLASMA DISPLAY PANEL AND ITS DRIVING METHOD

BACKGROUND OF THE INVENTION

1. Field of the Invention

The present invention relates to electrode structure of a plasma display panel, referred to hereinafter as a PDP, and its driving method.

2. Description of the Related Arts

PDP is a thin display device of self-luminescent type which allows a high-speed display so as to suit the television.

AC type color A PDPs of a surface discharge type have been popularly employed, resulting in a rapid increase in application od PDP's. Accordingly, there has been required further improvement of the picture quality, such as 256 gradations, so as to achieve large screens of High-Definition TV and computer display, etc.

Figure 1:
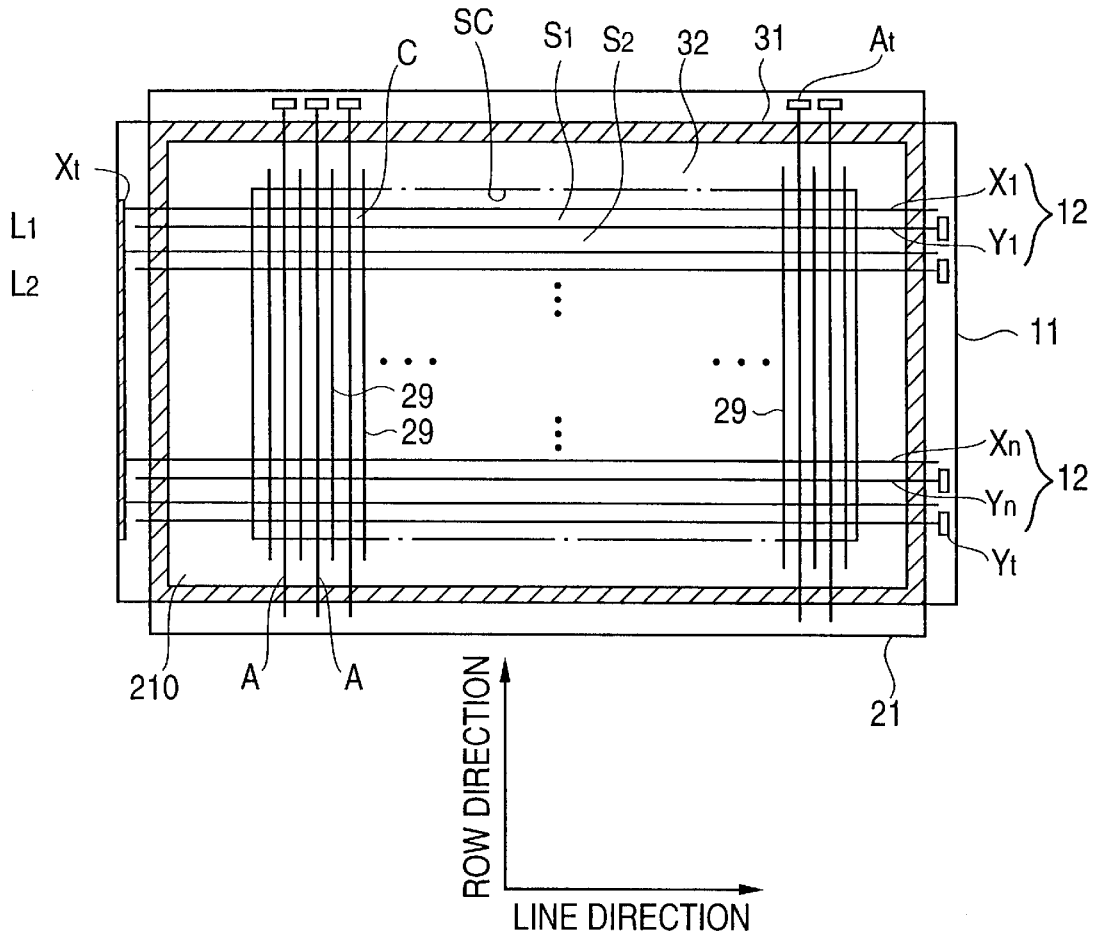
FIG. 1 (PRIOR ART)

An electrode matrix of an AC type surface-discharge PDP is composed of plural pairs of first and second sustain electrodes X & Y extending in a first direction of display lines and address electrodes A extending in a second direction of rows orthogonal display lines, respectively, as shown in FIG. 1.

The sustain electrode pairs are provided on a first substrate of a substrate pair which composes the panel envelope. A space S1 between the first and second sustain electrodes Xn & Yn, referred to hereinafter as a discharge slit, constitutes respective lines. The suffix n indicates the electrodes are of the n-th line. However, the suffix n may be hereinafter omitted unless the line must be specifically distinguished from the adjacent line, for the explanation.

Both the sustain electrodes are covered with a dielectric layer extending along the entire screen so as to be insulated from a discharge space formed between the first and second substrates.

A single cell C is formed at the intersection of each discharge slit and each address electrode, including the vicinity of the intersection. The cell C is a single unit luminous area.

A memory effect of each cell is utilized to maintain, i.e. to sustain, the lighting state of the cell.

AC type PDPs are constituted so as to possess structurally the memory function by covering the display electrodes with the dielectric layer.

In operating the AG type PDPs, after the wall charges are accumulated only on the above-mentioned dielectric layer of the cell which should light according to the data of the display, voltages of alternating polarity, i.e, sustain voltages, are applied commonly across the cells. This sustain discharge is the surface discharge along the surface of the above-mentioned dielectric layer.

The sustain voltage is lower than the firing voltage between the sustain electrodes. In the cells having the wall charges, a voltage generated by the wall charge is superposed onto the sustain voltage, therefore, an effective voltage, referred to hereinafter a cell voltage, across the cell exceeds the firing voltage so that a discharge is caused therein.

The wall charges having the polarity opposite from the previous state accumulate, after the previous wall charges disappear once in the discharge. Therefore, each time the sustain voltage is alternately applied, the discharge takes place. When the application cycle of the sustain voltages is shortened, a visually continuous lighting state is achieved.

Figure 2:
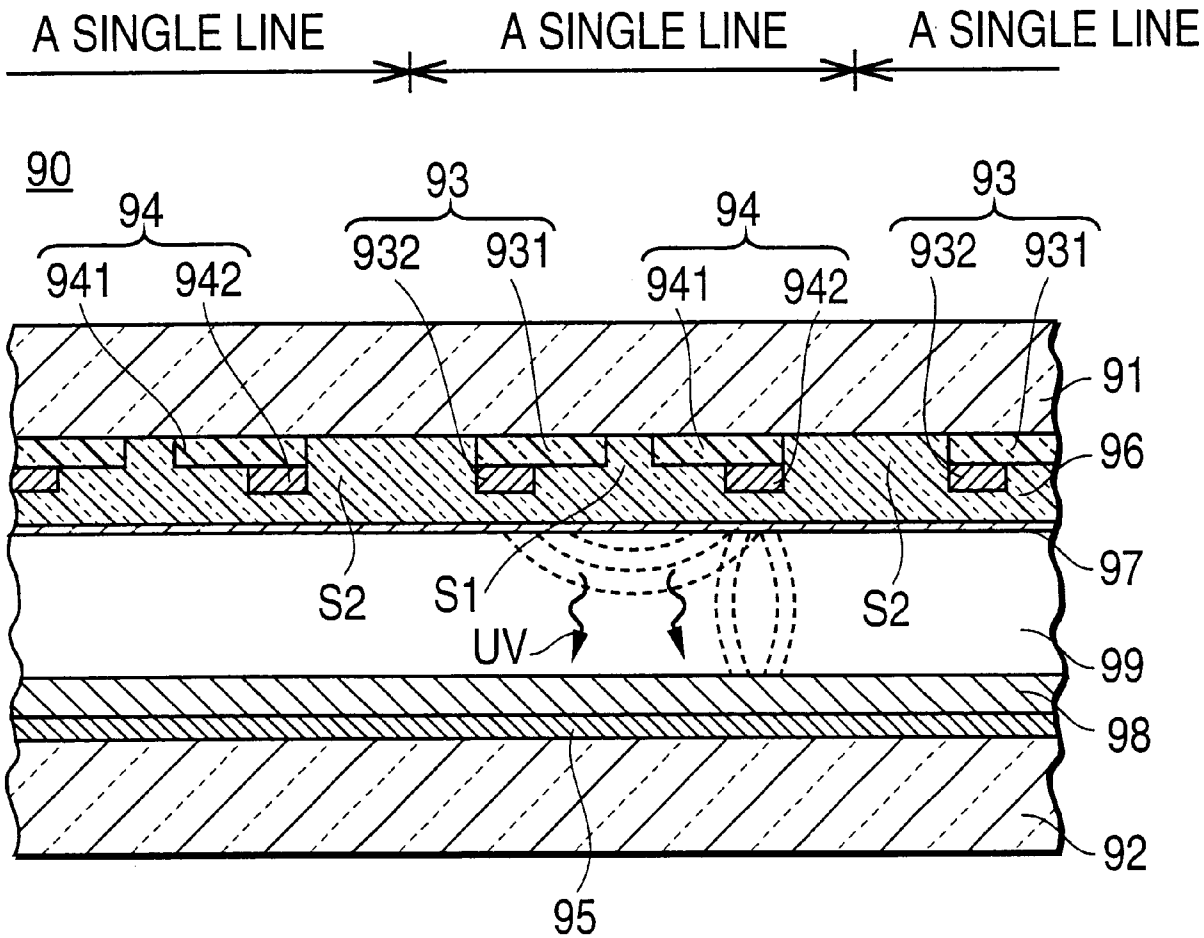
FIG. 2 (PRIOR ART)

FIG. 2 schematically illustrates an internal structure of a typical prior art PDP of the surface discharge type. In PDP 90, a plurality of pairs of first and second sustain electrodes 93 & 94 are arranged on the inner surface of a front glass substrate 91 so as to extend along the direction of the lines of the display matrix, that is in the direction vertical (i.e., perpendicular) to the sheet of FIG. 2.

A space between the electrode pair, that is a discharge slit, forms a single line. These matters will be described later in detail.

There is provided a dielectric layer 96 so as to insulate sustain electrodes 93 & 94 from discharge space 99. A protection film 97 is deposited on the surface of dielectric layer 96. Dielectric layer 96 and protection film 97 are both transparent.

On the other hand, in the inner surface of back glass substrate 92, address electrodes 95 are arranged orthogonal to sustain electrodes 93 & 94. A fluorescent layer 98 is provided so as to cover back glass substrate 92 and the surface of address electrodes 95. The fluorescent layer thus located far from the surface discharge can decrease the deterioration of the fluorescent layer caused from ion bombardment thereto.

The address electrodes are arranged generally on the substrate of the side where the fluorescent layer is coated, in order to avoid an increase in the electric power consumption caused from stray capacitance between the sustain electrodes and the address electrodes.

The first sustain electrode 93 is composed of a belt of a metal film 932 narrower than a belt of a transparent conductive film 931. The second sustain electrode 94 is similarly composed of a belt of a metal film 942 narrower than the belt of a transparent conductive film 941. Metal films 932 & 942 are supplementary conductors to accomplish good electrical conductivity, and are stacked on an edge of a side apart from the surface discharge slit between transparent conductive films 931 & 941, respectively.

In a display operation of PDP 90, addressing operation is usually performed sequentially in the order of the lines. In lighting a certain cell, the address electrodes 95 and the second sustain electrodes 94 associated with respective cells are appropriately biased so as to cause an opposing discharge in the direction of the thickness of the panels so that the wall charges are accumulated on the surface of dielectric layer 96, where protection film 97 is assumed to be a part of dielectric layer 98.

When the cell is not to be lit, the voltage of each electrode is set so as to not cause the opposing discharge with address electrodes 95. After the address period in which lighting/non-lighting of the cell is thus set, the sustain voltages are applied between the first and the second sustain electrodes 94 and 93 so that the polarity of the voltages applied between these sustain electrodes may change alternately, whereby the surface discharge takes place along the dielectric layer ever the discharge slit upon each transition of the applied voltages.

Fluorescent layer 98 is partially excited by ultraviolet rays UV generated by the discharge so as to radiate a visible light of a predetermined color. Among these visible lights the light that has penetrated through front glass substrate 91 becomes a display light.

Lighting efficiency can be improved by expanding the surface discharge area while suppressing the shading of the display light to the minimum, by constituting first and the second sustaining electrode 93 & 94 located on the front side of discharge space 99 with the above-described layered structure.

A part, in the line direction, or discharge slit S1 is a surface discharge gap. The width or discharge slit S1, that is a size in a direction perpendicular from sustain electrode 93 & 94, is selected so that a surface discharge may be properly caused by an application of a driving voltage of 100 to 200 V.

On the other hand, a slit S2 between an n-th second sustain electrode 93 and the nest n+1 th first sustain electrode 94 of the adjoining line is called "a reverse slit"; and the width of reverse-slit 62 is selected so wider enough than that of discharge slit 81 that no discharge is generated across reverse-slit S2. Each line can be selectively discharged by thus providing discharge slit S1 and reverse-slit S2 in the arrangement of the first and second sustaining electrodes 93 & 94.

The opposing discharge, referred to herein after 95 an address discharge, in the addressing operation is initiated between address electrode 95 and the second metal film 942 of second sustain electrode 94, and then, as the wall charges accumulate upon the surface or insulating layers 96 and 97, shifts to a discharge between address electrode 95 and second transparent conductive film 941.

The address discharge terminates when the electric field in discharge space 99 becomes weak due to the accumulation of the wall charges above the second transparent conductive film 941, in the direction to cancel the applied electric field.

The reason why the discharge takes place first between the second metal film 942 and address electrode 95 is that second metal film 942 is located nearer to address electrode 95 than the second transparent conductive film 941. Charging current flows into second sustain electrode 94 before starting the address discharge because discharge space 99 is a kind of condenser.

Second metal film 942 is of lower resistance than that of second transparent conductive film 941; accordingly, the current density of second metal film 942 is larger than that of the second transparent conductive film 941. Therefore, in the vicinity of the second metal film 942, there is generated a stronger electric field than in the vicinity of second transparent conductive film 941, whereby the discharge takes place easily.

However, as the quantity of the lines increases, to meet demands for higher resolution of the screen, the length of the period, allocatable in addressing a single line within the display period or a single frame, decreases the wall charges accumulated in the vicinity of slit S1 during the discharge are and, accordingly, lighting errors are more likely to take place, resulting in emitting no light during subsequent sustain period.

This is because, when the addressing period is short, the voltage application to the electrode is released thereby to terminate the address discharge before the address discharge shifts to the discharge between transparent conductive film 941 and address electrode 95 where the charge must be saturated.

The increase in the number of gray scale grades also causes the shortening of the addressing period.

Moreover, in the prior art structure there was another problem in that erroneous lightings of surface discharge cells of adjacent lines are likely to take place because comparatively much of the wall charges accumulate upon the insulating layer on reverse-slit S2, too.

In addition, in the prior art there was a further problem in that the applied voltage, necessary to cause the address discharge between the address electrode and the sustaining electrode, has to be large.

Therefore, it was difficult to increase the space size of the discharge slit S1 in order to improve the brightness of the cell.

SUMMARY OF THE INVENTION

It is a general object of the present invention, therefore, to achieve an error-free high-speed display by accumulating the wall charges necessary in sustaining operation in a shortest period as possible during the address discharge.

It is another object of the present invention to enhance, relative to conventional PDP's the brightness while allowing a decrease in the applied voltage during the addressing operation, or by allowing an increase of the size of the discharge space with the same voltage applied thereto.

It is still another object of the present invention to prevent the deterioration of an electrode-protection layer.

In a plasma display panel including first and second sustain electrodes each extending along a line direction and spaced apart by a slit; a discharge space; a dielectric layer coated on the first and second sustain electrodes so as to insulate the first and second sustain electrodes from the discharge space, and an address electrode crossing and opposing the first and second sustain electrodes via the dielectric layer and the discharge space, where a first discharge for addressing operation is generated between the second sustain electrode and the address electrode, and a second discharge for lighting is generated along a surface of said dielectric layer in the direct vicinity of the slit, wherein the first and second sustain electrodes comprise first and second belt-like transparent electrodes with first and second metal electrodes thereon, respectively, where the first and second metal electrodes are narrower than the first and second transparent electrodes, respectively, wherein the first metal electrode is located on an edge apart from the discharge slit; and the second metal electrode is located on another edge near to the discharge slit. A width of the second metal electrode may be wider than a width of said first metal electrode.

A clearance between the second sustain electrode and the address electrode may be smaller than a clearance between the first sustain electrode and the address electrode. In this electrode structure, a first rise time of a first sustain pulse which makes the second sustain electrodes negative with respect to the first sustain electrode is preferably slower than a second rise time of a second sustain-pulse which makes the second sustain electrodes positive with respect to the first sustain electrode.

The second sustain electrode may be formed of a belt-like metal electrode only.

The above-mentioned features and advantages of the present invention, together with other objects and advantages, which will become apparent, will be more fully described hereinafter, with references being made to the accompanying drawings which form a part hereof, wherein like numerals refer to like parts throughout.

A BRIEF DESCRIPTION OF THE DRAWINGS

Figure 3:
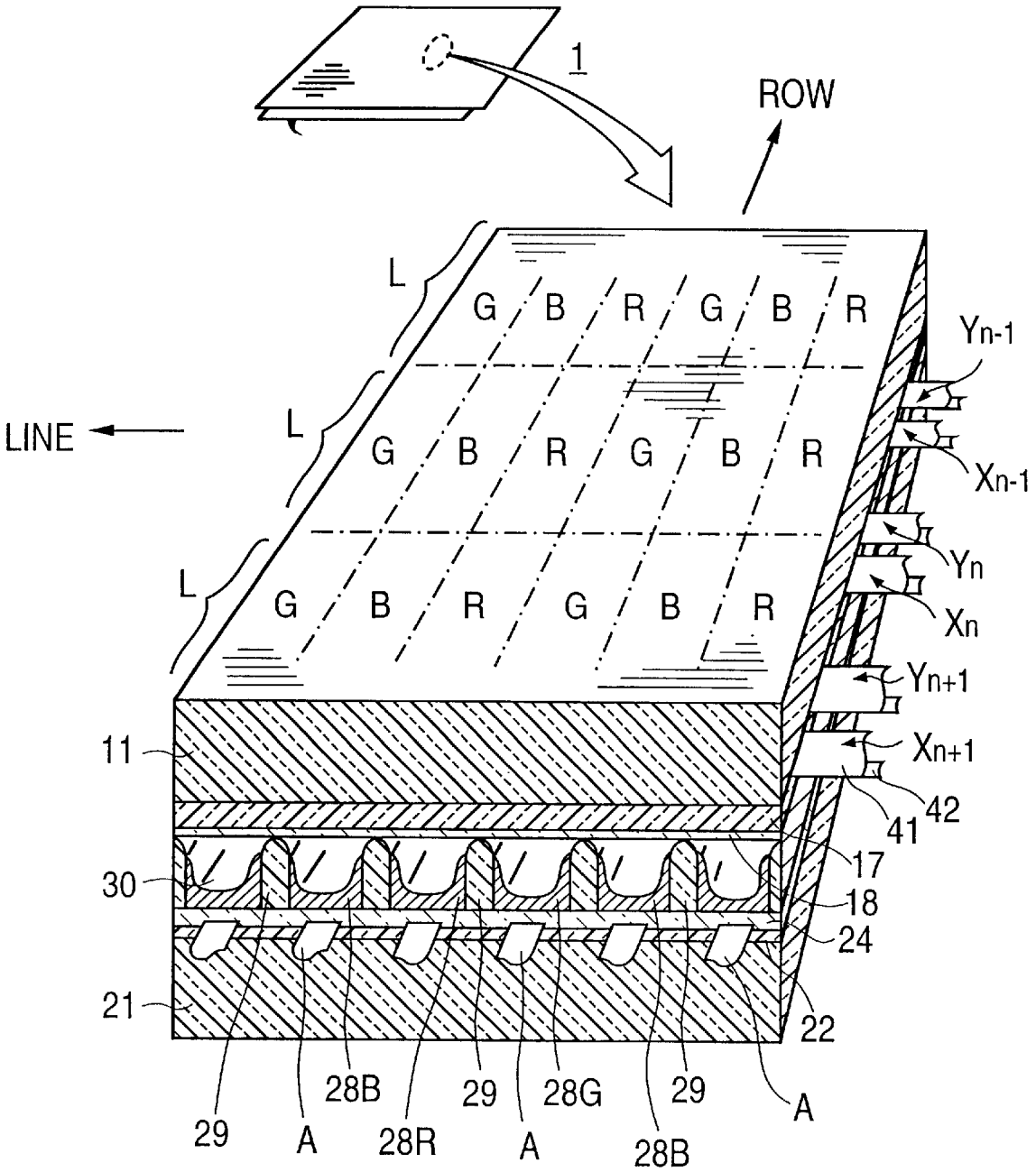
Figure 4:
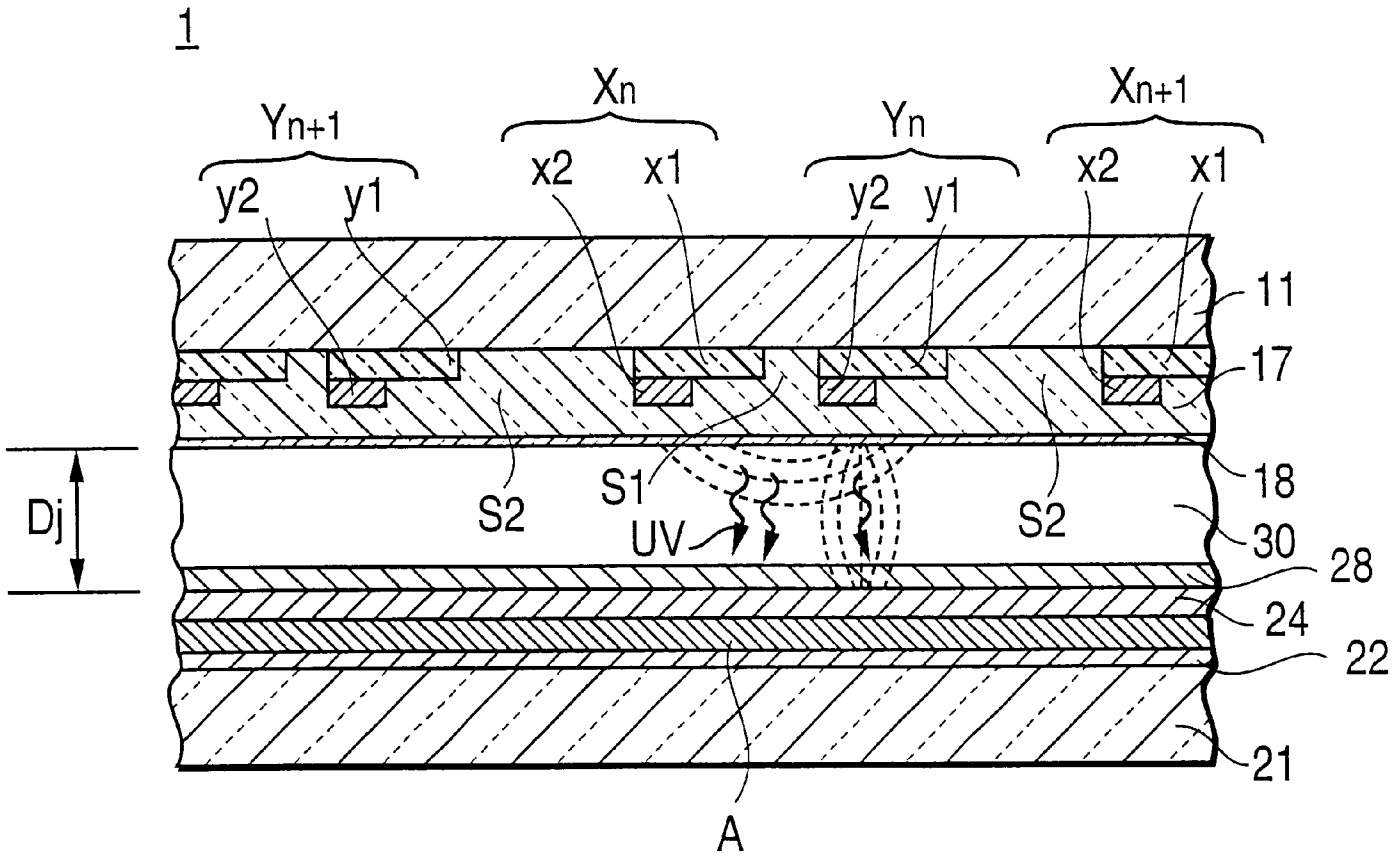
Figure 5:
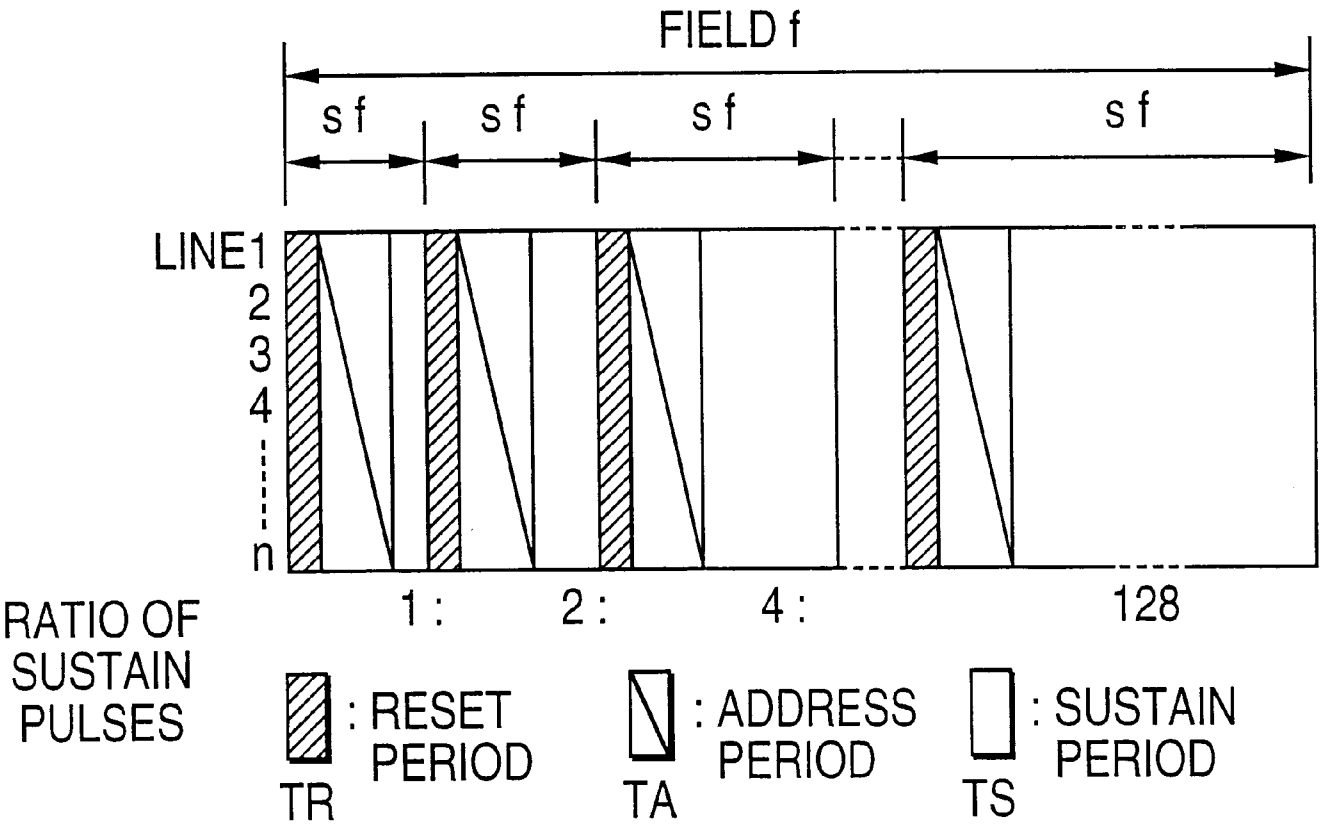
Figure 6:
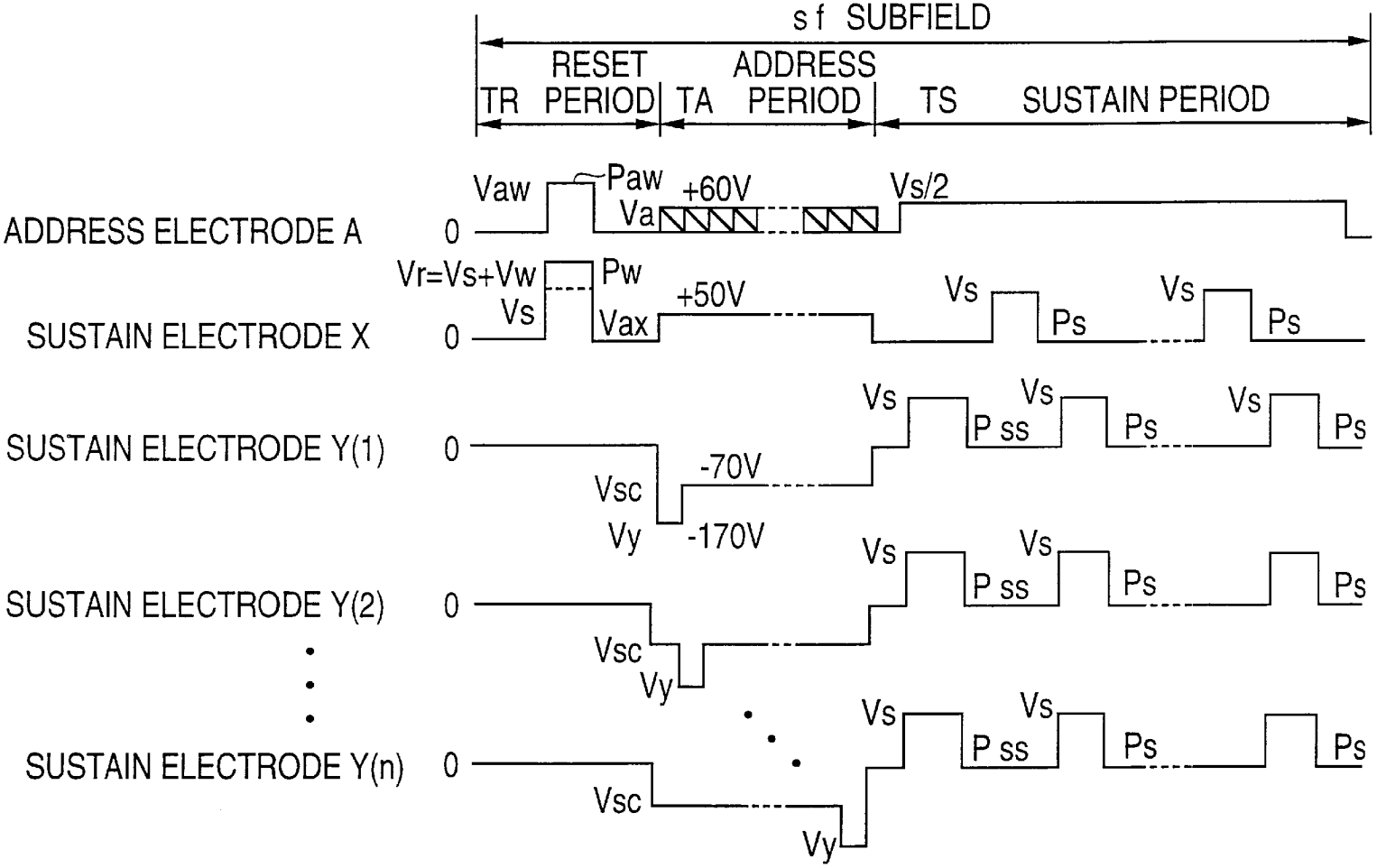
Figure 7A:
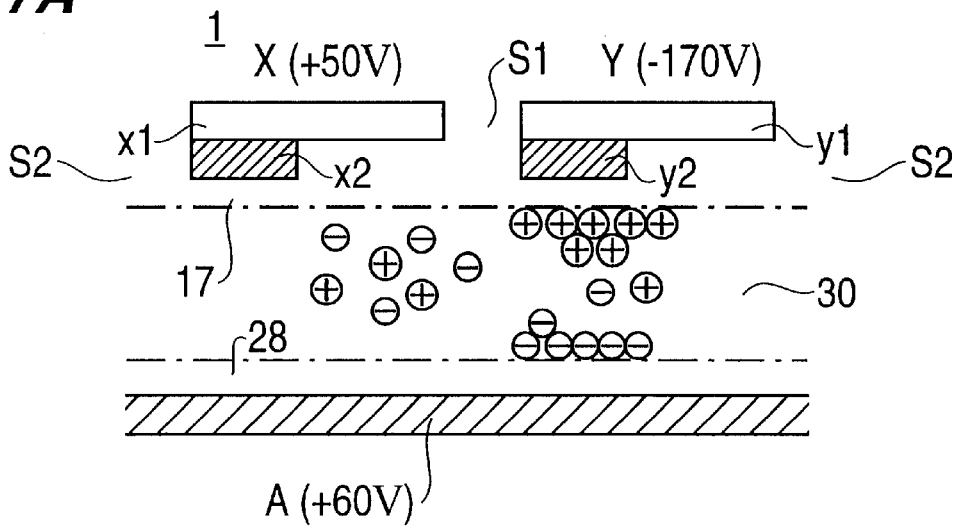
Figure 7B:
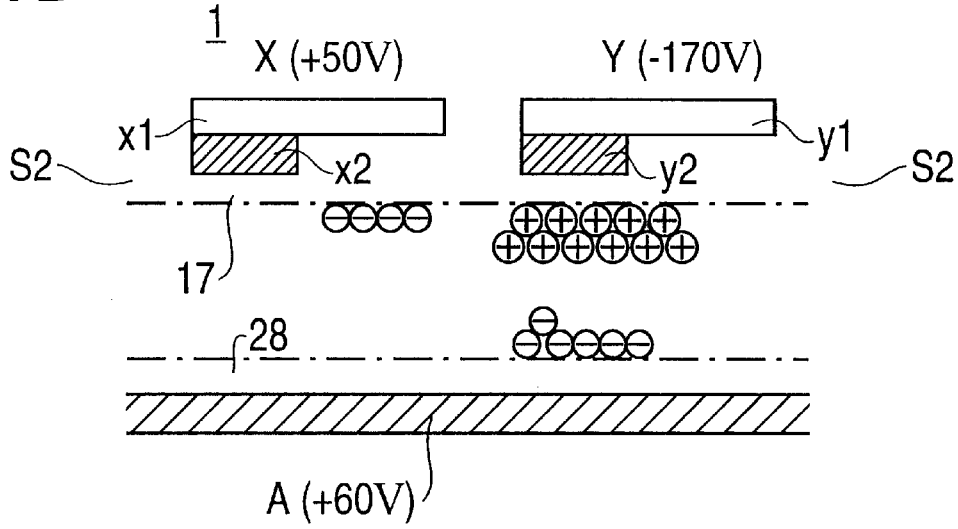
Figure 8:
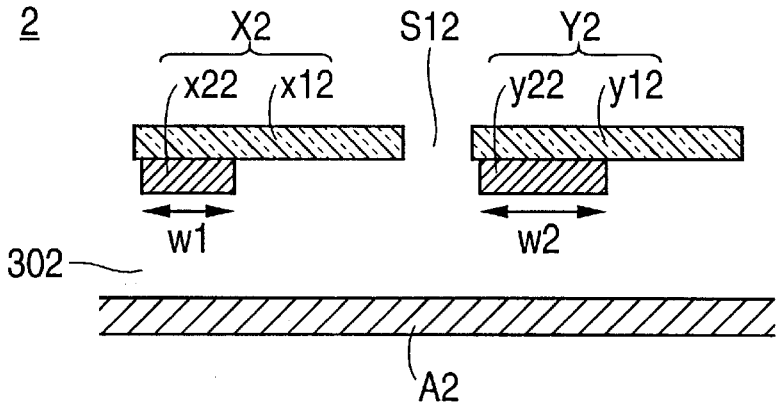
Figure 9:
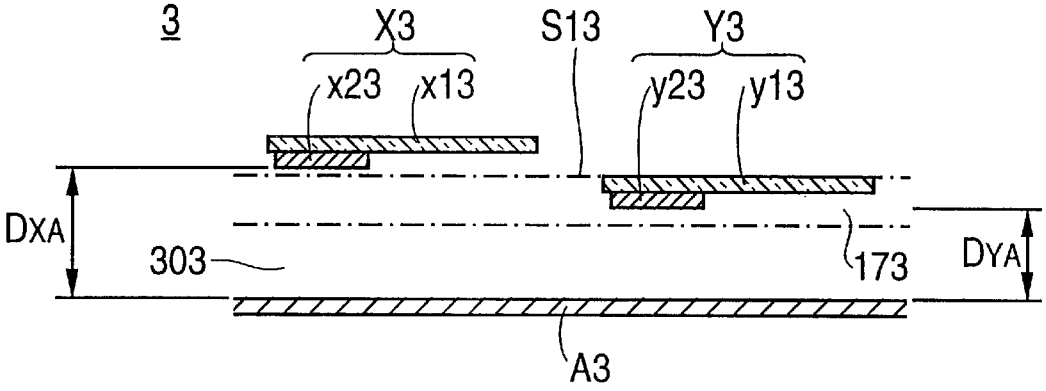
Figure 10:
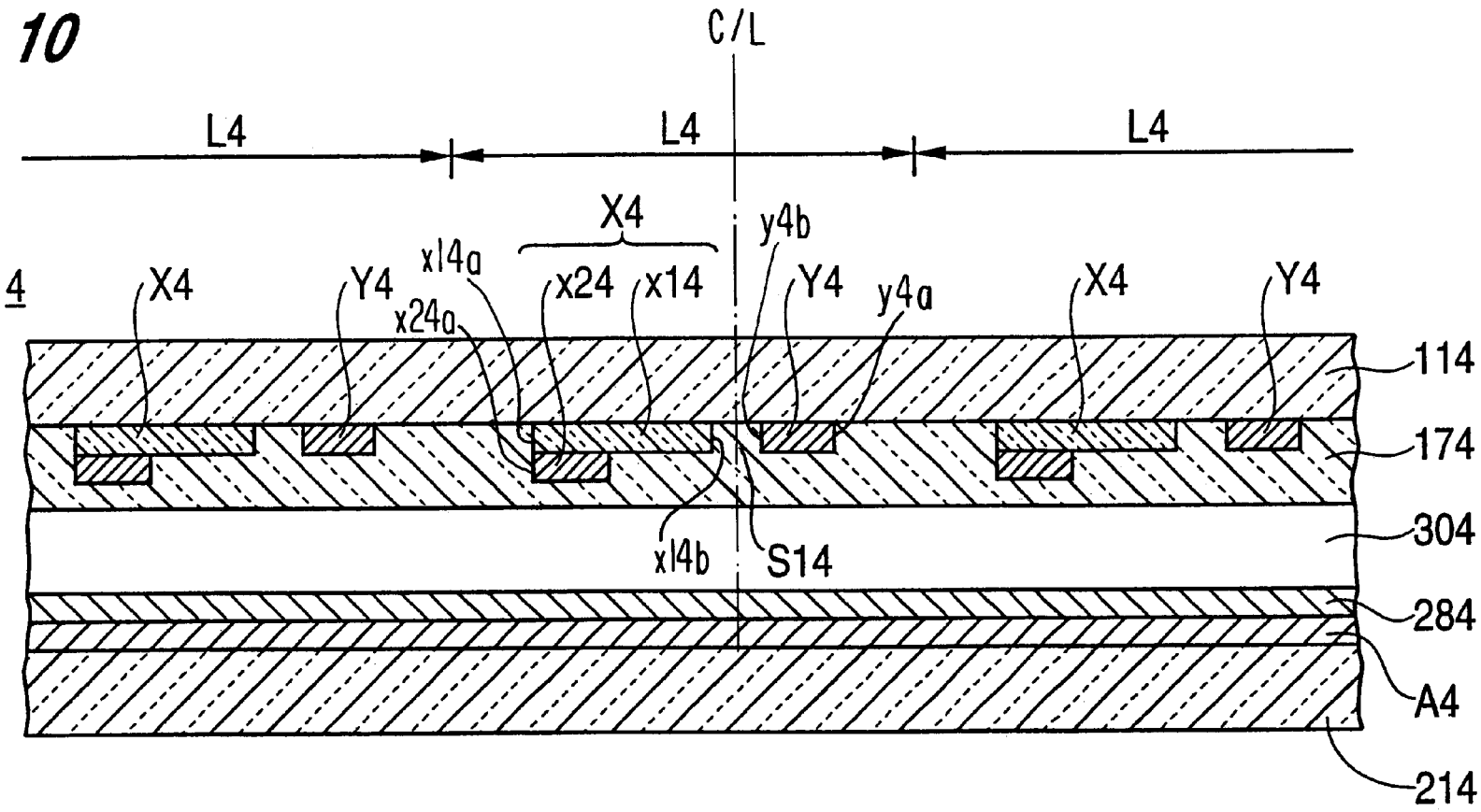
Figure 11:
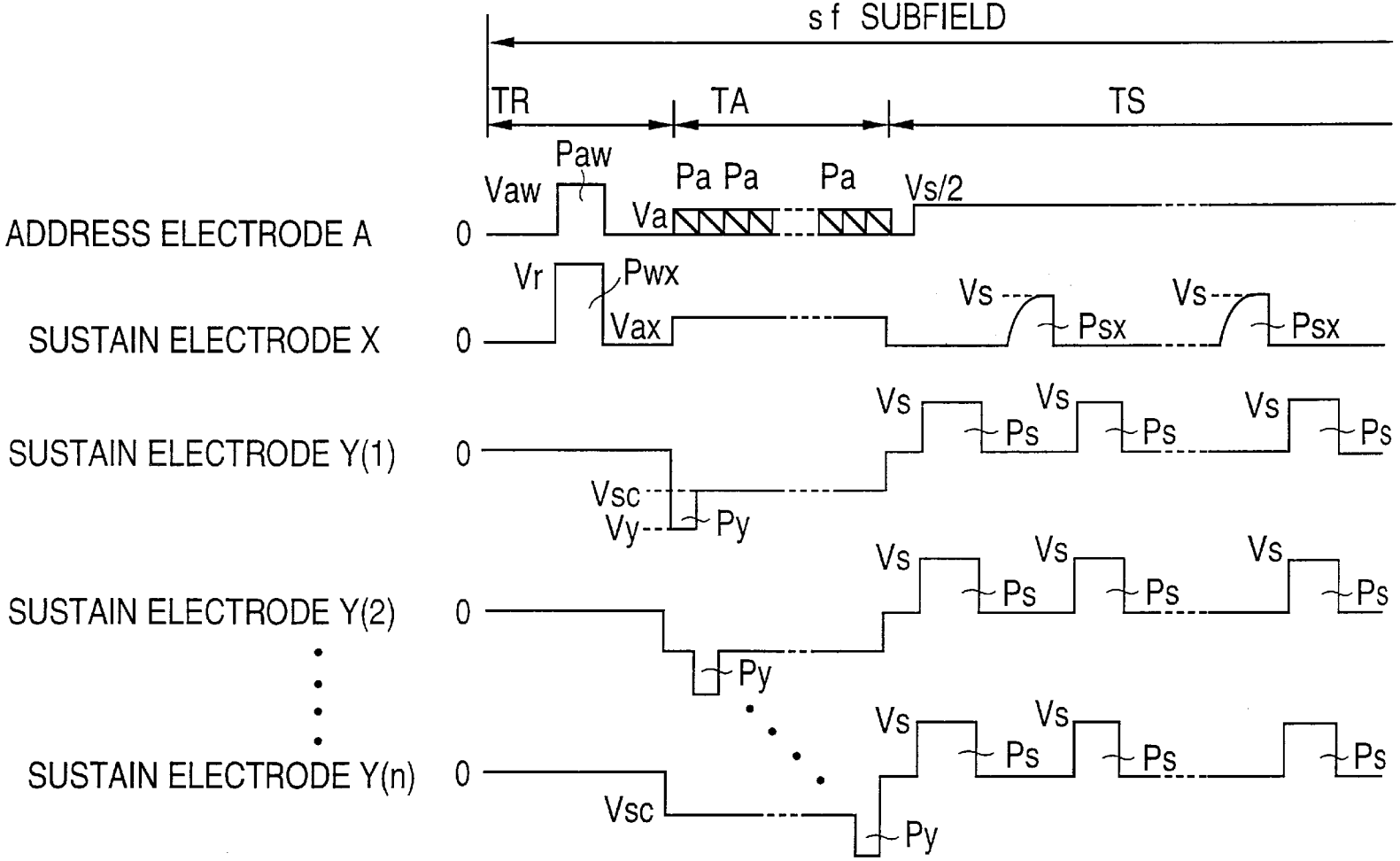
Figure 12A:
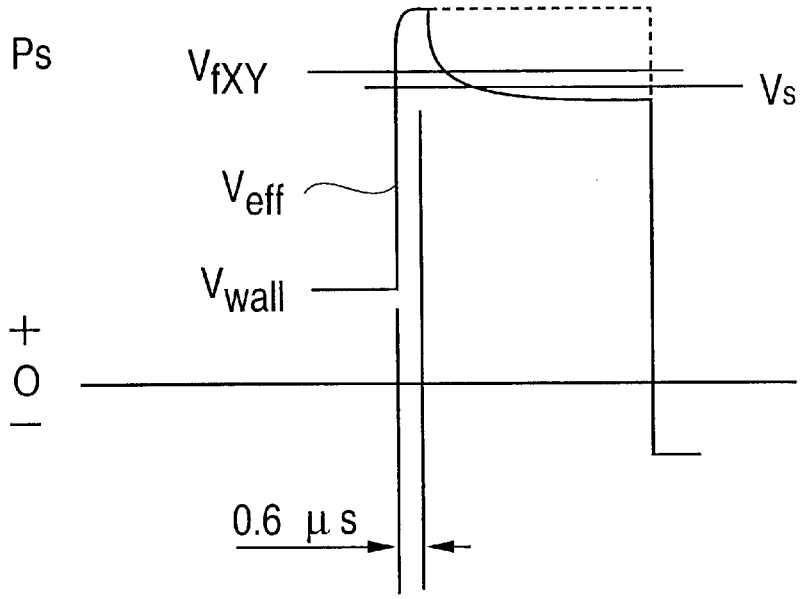
Figure 12B:
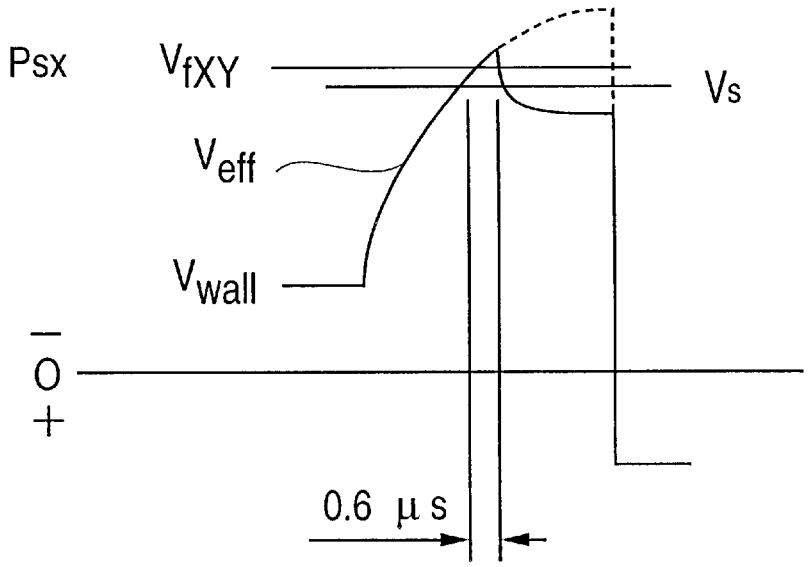
Figure 13:
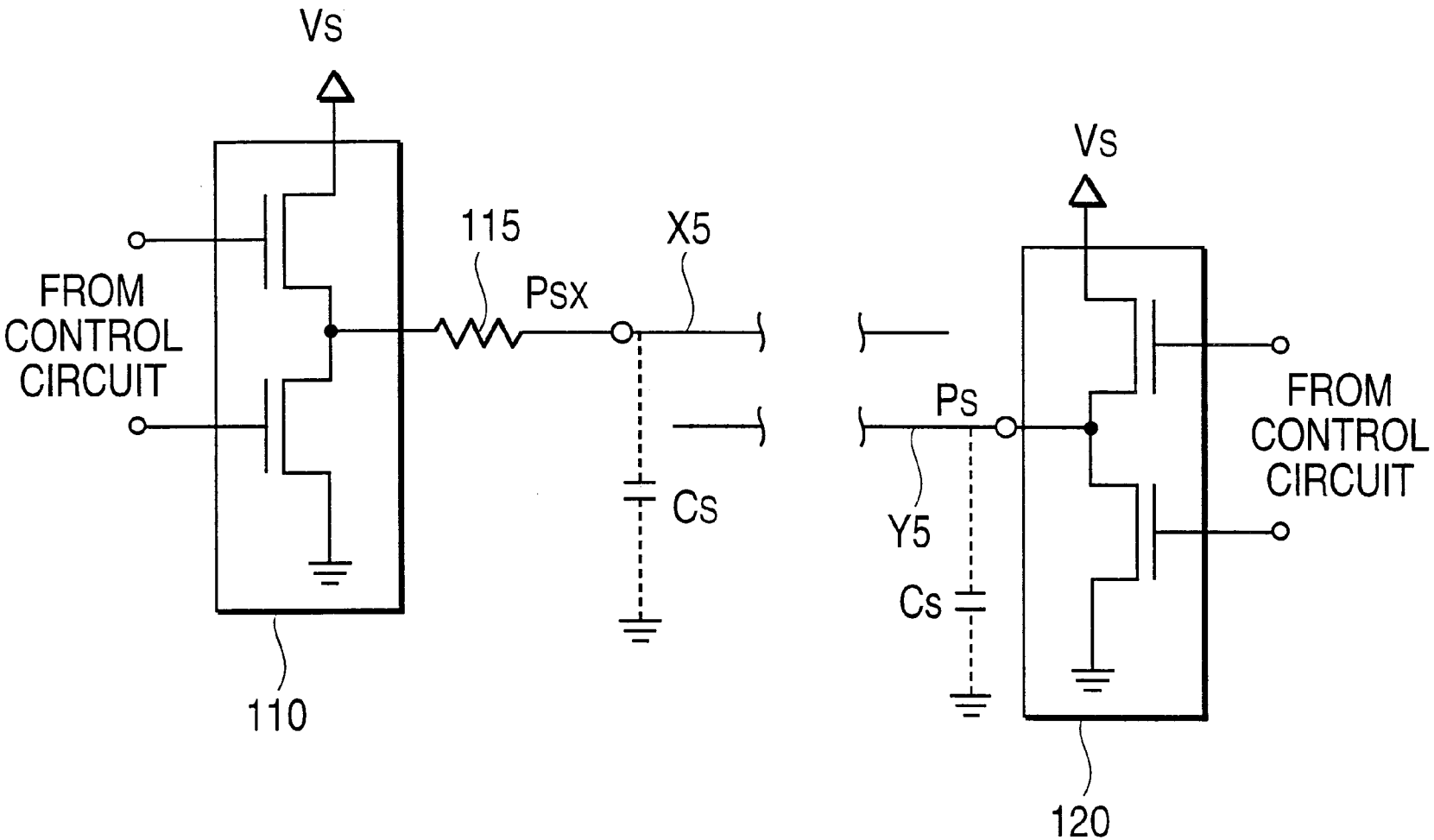

FIG. 1 schematically illustrates a matrix structure of a PDP which can be embodied by the present invention;

FIG. 2 schematically illustrates a perspective view of a prior art PDP;

FIG. 3 schematically illustrates a perspective view of a PDP of the present invention;

FIG. 4 schematically illustrates a first preferred embodiment of the present invention;

FIG. 5 schematically illustrates a block diagram of the field;

FIG. 6 schematically illustrates waveforms of the applied voltage in the first preferred embodiment of the present invention;

FIG. 7A and FIG. 7B schematically illustrate the transition of the wall charge during the address period;

FIG. 8 schematically illustrates the sustain electrode structure of the second preferred embodiment;

FIG. 9 schematically illustrates the sustain electrode structure of the third preferred embodiment;

FIG. 10 schematically illustrates the sustain electrode structure of the fourth preferred embodiment;

FIG. 11 schematically illustrates waveforms of the applied voltages as a fifth preferred embodiment;

FIG. 12A and FIG. 12B schematically illustrate waveforms of the sustain voltages of the fifth preferred embodiment; and FIG. 13 schematically illustrates a block diagram of the driving circuit of the fifth preferred embodiment.

DETAILED DESCRIPTION OF THE PREFERRED EMBODIMENTS

A first preferred embodiment of the present invention is hereinafter explained with reference to FIG. 1 schematically illustrating the electrode matrix or a PDP 1, FIG. 3, a perspective view schematically illustrating the internal structure, and FIG. 4, a cross-sectional view cut along an address electrode of PDP 1 shown in FIG. 3.

PDP 1 shown in FIG. 3 is an AC type PDP of a surface discharge form capable of full color display, and is called a reflection type in the classification of the arrangement form of the fluorescent material.

In PDP 1, a plurality of pairs of the first and second sustain electrodes X & Y are arranged upon the inner surface of front glass substrate 11 of the substrate pair which composes the panel envelope.

A single line of the matrix display is formed of a single pair of the first and second sustain electrodes Xn & Yn, and a single row is formed of a single address electrode A. The pixel arrangement with the electrodes is further explained later in detail.

A dielectric layer 17 of a conventional thickness and which is typically formed of a low melting point glass is coated over the whole display area SC so as to isolate the sustain electrodes X & Y from the discharge space 30.

Upon the surface of dielectric layer 17 is deposited a magnesium oxide film, referred to hereinafter as MgO film, of several thousand angstrom thickness as a protection film 18. Dielectric layer 17 and protection film 18 are both transparent.

On the other hand, upon an inner surface of back glass substrate 21 are arranged plural address electrodes a, disposed orthogonally to first and second sustain electrodes X and Y; upon an undercoat layer 22, and, and covered with a dielectric layer 24 of about 10 $\mu$m thickness.

Upon dielectric layer 24 are provided about 150 $\mu$m high separator walls 29, each of which is seen as a straight bank in the bird view, each wall 29 between disposed two (2) adjacent address electrodes A.

Thus, discharge space 30 is divided along the direction of the line by these separator walls 29 into each cell, i.e. a unit luminous area, and also thereby space size Dj in the direction of thickness of discharge space 30 is determined.

Three color fluorescent layers 28R, 28G & 28B, which will be referred to simply as fluorescent layer 28 unless the colors need to be specifically distinguished, are provided so as to cover the surfaces of dielectric layer 24 as well as the sides of separator walls 29 including surfaces above address electrodes A. In discharge space 30 is filled with a Penning gas, which is a mixture or xenon or 1 to 15% mole in neon.

A pixel that is a single picture element of the display is composed of adjacent cells R, G and B, which are called three sub-pixels, in each line L, as shown in FIG. 3. Thus, the luminous color in each row is the same. In FIG. 1 is illustrated the locations of the cells C in the matrix.

In PDP 1, there is no separator wall to divide discharge space 30 along the row direction, that is in the direction orthogonal to sustain electrodes.

Therefore, reverse-slit S2 between the lines L is selected to be wider than 80 to 140 $\mu$m wide discharge slit S1, accordingly is typically 400 to 500 $\mu$m wide.

As shown in FIG. 4, first sustain electrode X is formed of a transparent ITO (Indium-TinOxide) film x1 patterned belt-like when looked at in a bird view, and a metal film x2 patterned narrower than ITO film x1.

Second sustain electrode Y is similarly formed of belt-like ITO film y1 and a belt-like metal film y2 narrower than ITO film y1. Metal films x2 and y2 are both non-transparent thin films formed typically of a three-layer structure of chrome/copper/chrome, and are provided as a supplementary conductor to reduce the resistance of sustain electrodes X & Y, upon the surface of ITO films x1 and y1 at the side facing discharge space 30.

Metal film x2 of first sustain electrode X is located on the edge apart from discharge slit S1 of ITO film x1, similar to prior art FIG. 2.

On the contrary, metal film y2 of the second sustain electrode Y is located on the edge near discharge slit S1 of ITO film y1.

Concrete examples of the sizes of ITO films x1 & y1 and metal films x2 & y2 are shown in Table 1. The figures in Table 1 are design values of a 42 inch screen size. Preferable range of the thickness of ITO films x1 & y1 is 0.015 to 0.03 $\mu$m, and preferable range of the width is 250 to 300 $\mu$m. Preferable range of the thickness of metal films x2 & y2 is 1 to 4 $\mu$m, and preferable range of the width is 50 to 200 $\mu$m.

TABLE 1

| Structural Element | Thickness | Width |
|---|---|---|
| ITO Films | 0.02 $\mu$m | 275 $\mu$m |
| Metal Films | 2 $\mu$m | 100 $\mu$m |

Table 2 shows the specification of the screen of PDP 1.

TABLE 2

| Items | Specification |
|---|---|
| Screen Size | 42 inches |
| Aspect Ratio | 16:9 |
| Number of Pixels | 852 × 480 |
| Number of Sub-Pixels | 2556 × 480 |
| Pixel Pitch | 1.08 mm |
| Sub-Pixel Arrangement | RGBRGB |

Frame-like area 31 indicated with slashes in FIG. 1 is an area for sealing front and back glass substrates 11 and 21.

All first sustain electrodes X are lead out to a horizontal end of front glass substrate 11; and all second sustain electrodes Y are lead out to the other, opposite end. The first sustain electrodes X are electrically connected with common terminal Xt in order to simplify the driving circuit.

Second sustain electrodes Y are individually independent so as to allow a line-by-line addressing, and are lead out individually via lead-out terminals Yt.

Address electrodes A are lead out via lead-out terminals At provided at a vertical end of back glass substrate 21.

The area where the discharge cells are defined with first and second sustain electrodes X & Y and address electrodes A within sealing area a31 is an effective display area a1, i.e. the screen SC.

Between effective display area SC and sealing area 31 is provided a frame-like non-display area 32 in order to be free from the influence of an outgassing from the sealing material. In non-display area 32 of back glass substrate 21 is provided a hole 210 (FIG. 1) to introduce the discharge gas to gas discharge space 30.

PDP 1 having the above-described constitution is used as a display device, such as tapestry type television receivers, in combination with the driving unit which is not shown in the figure. In such case, PDP 1 is electrically connected with a drive unit via a flexible wiring board, etc.

The driving method of PDP 1 is hereinafter explained. Hereinafter is recited an example of the application of the driving method disclosed as the third preferred embodiment of Japanese Provisional Patent Publication HEI 7-160218, to PDP 1.

FIG. 5 shows a block diagram of a field f of this driving method, and FIG. 8 shows waveforms or the applied voltages.

In display operation of PDP 1, a single field f corresponds to a single screen (a single frame), for instance. In displaying a gradation of 256 grades, a single field f is divided into eight subfields sf. Each subfield sf is divided into a reset period TR, an address period TA and a sustain period TS. Number of the lighting weighted for the visual brightness in sustain period TS of each subfield sf is set so that the relative ratio of brightness in each subfield sf may become 1:2:4:8:18:32:64:128. Thus, each subfield sf is for a display period of a certain gradation level.

In reproducing a screen to be scanned for the television of interlace system two fields f are employed to display a single screen, i.e. a single frame.

The wall charges in the effective display area SC are erased during reset period TR so as to be free from the effect of the previous lighting status.

In reset period TR, the driving unit applies a write pulse PW ot positive polarity having a peak value Vr (=Vs+Vw), which exceeds surface discharge firing voltage VfXY, onto first sustain electrode X, while second sustain electrode Y is maintained at 0 potential. Moreover, a positive pulse Paw having a peak value Vaw is applied concurrently to all address electrodes A.

In response to the rise of write pulse PW, a strong surface discharge takes place at all lines L so that wall charges once accumulate upon dielectric layer 17.

However, a self-discharge of the wall charges takes place in response to the fall of writing pulse PW, whereby the wall charges on dielectric layer 17 disappear.

Application of write pulse Paw is in order to suppress accumulation of the wall charges on the wall of the address electrode side of discharge space 30. Preferable peak value of Vaw is within the range shown in formula (1).

$$Va \geqq Vaw \geqq Vs \quad (1)$$

In the address period, the addressing operation is performed sequentially for each line. First sustain electrode X is biased with a positive potential Vax, for example +50V, with respect to the ground level; while all second sustain electrodes Y are biased with a negative potential Vsc, for example −70V.

Under such a condition, each line L is sequentially selected starting at a first line L1 so as to apply a negative scanning pulse Py to second sustain electrode Y1.

Second sustain electrode Y2 of selected line L2 is temporarily biased with a negative potential Vy, for instance, −170 V.

Concurrently with to selecting a line L, a positive address pulse Pa having a peak value Va, for instance +60 V, is applied to address electrode A that relates to a cell to be lit.

At the selected line L, an address discharge takes place between second sustain electrode Y and address electrode A of the cell to which address pulse Pa is applied.

Discharge does not take place between first sustain electrode X and address electrode A because first sustain electrode X is biased with a potential of the same polarity and having a potential close to address pulse Pa.

Moreover, bias potential Vax of first sustain electrode X is set so that the voltage difference between first sustaining electrode X and second sustain electrode Y is lower than surface discharge firing potential VfKY in order to prevent the wall charges from accumulating in the non-selected cell in the line L. Surface discharge firing potential VfXY is usually higher than firing potential VFAY between second sustain electrode Y and address electrode A.

Potential Vax and Vy and Va satisfy the following relations:

$$(|Vax|+|Vy|)<|VfXY| \quad (2)$$

$$(|Va|+|Vy|)\geqq|VfAY| \quad (3)$$

Sustain period TS is a period for sustaining a lighting state set by the addressing operation so as to accomplish the brightness in accordance with the gradation level.

In order to prevent the opposing discharge, all address electrodes A are biased with a positive potential, for instance, about Vs/2; and at first a positive sustain pulse Pss having a peak value Vs, where Vs<VfXY, is applied to all sustain electrodes Y.

Subsequently, positive sustain pulses Ps having peak value Vs are applied alternately to first sustain electrodes X and second sustain electrodes Y.

Upon each application of sustain pulses Pss or Ps, surface discharge takes place in the cell accumulated with the wall charges during address period TA.

In order to stabilize the charge accumulation, the pulse width of the first sustain pulse Pss is set longer than the width of subsequent sustain pulses Ps by 1 $\mu$s, for instance.

In FIGS. 7 is schematically illustrated a transition of the wall charges during address period TA.

The structure of PDP 1 is drawn simplified in this figure for the convenience of the explanation.

For instance, the address discharge takes place between second sustain electrode Y and address electrode A upon application of scan pulse Py of −170 V and address pulse of +60V.

This opposing discharge across discharge space 30 starts between metal film y2 and address electrode A of the second sustain electrode Y.

Then, as positive charges accumulate upon dielectric layer 17 the discharge shifts to an adjacent discharge between ITO film y1 and address electrode A.

As negative charges accumulate upon fluorescent layer 28, the electric field between the second sustain electrode Y and address electrode A is weakened by the accumulation of the positive and negative charges so as to terminate the address discharge.

The charges accumulated upon dielectric layer 17 in the vicinity of discharge slit S1 are more, than in the case where the metal film is located apart from discharge slit S1, because metal film y2 is located close to discharge slit S1, as shown in FIG. 7A.

On the other hand, owing to floating charges generated by the address discharge in discharge space 30 near discharge slit S1, its priming effect reduces surface discharge firing potential VfXY.

Consequently, a discharge takes place between first sustaining electrode X and second sustain electrode Y, as well, so as to increases the amount of the accumulated wall charges on the dielectric layer 17, as shown in FIG. 7(B).

The wall charges accumulated in the vicinity of discharge slit S1 advantageously acts on the subsequent sustain operation.

Moreover, the address discharge in the vicinity of discharge slit S1 is effective in preventing the erroneous lighting of adjacent lines. This is because the wall charges hardly accumulate near the reverse-slit S2.

In FIG. 8 is schematically illustrated a sustain electrode structure or a PDP 2 of the second preferred embodiment of the present invention. PDP 2 is also of the surface discharge type similar to the above-described PDP 1.

There are first sustain electrode X2, second sustaining electrode Y2 and address electrode A2 for each cell of the display matrix. First and second sustain electrodes X2 and Y2 are insulated with a dielectric layer, which is not shown in the figure, from discharge space 302.

First sustain electrode X2 consists of a transparent conductive film x12 and a first metal film x22 as a supplementary conductor. First metal film x22 is deposited on the surface, facing the discharge space, or transparent conductive film x12, and is located on an edge, apart from discharge slit S12, of transparent conductive film x12.

Second sustain electrode Y2 consists of a transparent conductive film y12 and a second metal film y22 which is a supplementary conductor, as well. Second metal film y22 is deposited on the surface, facing the discharge space, of transparent conductive film y12, and is located on an edge, near to discharge slit S12, of transparent conductive film y12.

The feature of PDP 2 of the second preferred embodiment in comparison with PDP 1 of the first preferred embodiment is in that the width w2 of the second metal film y22 is wider than width wl of the first metal film x22.

The width of the second transparent conductive film y12 is substantially equal to the width of the first transparent conductive film x12. Because the electrical resistance of the second sustaining electrode Y2 is reduced by enlarging width w2 of second metal film y22, the voltages can be efficiently applied to the cells.

In driving PDP 2, similarly to PDP 1, the second sustaining electrode Y2 and the address electrode A2 are used in the addressing operation, and the first sustain electrode X2 and the second sustain electrode Y2 are used in sustaining operation.

In the addressing operation, the address discharge is enhanced by the decrease in the electrical resistance or second sustain electrode Y2 compared with PDP 1 so as to increase the amount of the accumulation of the wall charges.

In FIG. 9 is schematically illustrated a sustain electrode structure of PDP 3 of the third [preferred embodiment of the present invention. PDP 3 is also of the surface discharge type similar to above-described PDP 1. Each cell of the matrix display is associated with first sustain electrode X3, second sustain electrode Y3 and address electrode A3. First and second sustain electrodes X3 and Y3 are insulated from discharge space 303 by dielectric layer 173.

First sustain electrode X3 consists or a transparent conductive film x13 and a first metal film x23 as a supplementary conductor. First metal film x23 is deposited on the surface, facing the discharge space, of transparent conductive film x12, and is located on an edge, apart from discharge slit 812, of transparent conductive film x13.

Second sustain electrode Y3 consists of a transparent conductive film y13 and a second metal film y23 which is a supplementary conductor, as well.

Second metal film y23 is deposited on the surface, facing the discharge space 303, of transparent conductive film y13, and is located on an edge, near to discharge slit S13, of transparent conductive film y13.

The feature of PDP 3 of the third preferred embodiment in comparison with PDP 1 of the first preferred embodiment is in that the second metal film y23 is located closer to address electrode A than the first metal film x23. This structural feature is caused by forming first sustain electrode X3 and second sustain electrode Y3 sequentially in this order. That is, after first sustain electrode X3 is formed the dielectric material is coated thereon; next, second sustain electrode Y3 is formed thereon.

It is possible to have second metallic film y23 thicker than first metal film x23 so as to be closer to address electrode A3; however, the manufacturing process becomes more complex than the above-described sequential forming. 0048

In driving PDP 3, similarly to the above-mentioned preferred embodiments second sustain electrode Y3 and address electrode A3 are used in the addressing operation; and first sustain electrode X3 and second sustain electrode Y3 are used in the sustain operation.

In the addressing operation, the address discharge is enhanced compared with PDP 1 by the amount by which the second sustain electrode Y3 is nearer to address electrode A3 whereby the amount or the accumulated wall charges is increased.

More preferable driving method of the PDP of the third preferred embodiment will be described later in detail as a sixth preferred embodiment.

A fourth preferred embodiment of the present invention is hereinafter described with reference to FIG. 10 schematically illustrating a main structural portion of PDP 4.

PDP 4 is of the surface discharge type having the three electrodes in each unit luminous area of the display matrix, similar to the above-mentioned preferred embodiments.

First and second sustain electrodes X4 & Y4, forming a pair, are arranged upon an inner surface of front glass substrate 114 for each line L4 of the display matrix.

For the AC drive, a dielectric layer 174 is provided so as to insulate these sustain electrodes X4 & Y4 from discharge space 304. Upon the surface of dielectric layer 174 is deposited a protection film, which is not shown in the figure.

Dielectric layer 174 is transparent. Upon the inner surface of back glass substrate 214 is arranged address electrode A4 for each row of the display matrix so as to cross first and second sustain electrodes X4 & Y4.

Fluorescent material layer 284 is coated to cover glass substrate 214 including the surface of the dielectric layer above address electrodes A4.

First sustain electrode X4 is composed of a first transparent conductive film x14, which is belt-like when looked at in a bird-view, and a metal film x24 which is belt-like and narrower than first transparent conductive film x14.

On the other hand, second sustain electrode Y4 is composed of the second metal only. First metal film x24 is a supplementary conductor to accomplish good conductivity, and is stacked on transparent conductive film 14 with respective edges x14*a* and x24*a* thereof remote from discharge slit S14 in aligned relationship; in FIG. 10, the dash-dot-line C/L represents a center line of the discharge slit S14, half way between the adjacent edges x14*b* of the first transparent conductive film x14 and the edge y4*b* of the second metal film Y4, the later having a further, opposite edge y4*b* remote from the discharge slit S14.

In driving PDP 4, similarly to the above-mentioned preferred embodiments, second sustain electrode Y4 and address electrode A4 are used in the addressing operation; and first sustain electrode X4 and second sustain electrode Y4 are used in the sustain operation.

A driving method of PDP 3 of the third preferred embodiment is hereinafter described as a fifth preferred embodiment.

First of all, the address discharge is performed during the address period for the cell to be lit, between address electrode A and second sustain electrode Y. Electrode distance to determine the address discharge firing voltage, that is the opposing distance $D_{YA}$ between second sustain electrode Y3 and address electrode A is smaller than the opposing distance $D_{XA}$ between first sustain electrode X3 and address electrode A, that is $D_{YA}<D_{XA}$.

Moreover, a portion of dielectric layer 173 to cover second sustain electrode Y3 is thinner than another portion of dielectric layer 173 to cover first sustain electrode X3. Owing to these facts, address discharge is caused by a voltage application lower than that of the prior art electrode structure.

Waveforms or the voltages applied to PDP 3 are hereinafter described with reference to FIG. 11 and FIG. 12, particularly with regard to the difference from those of FIG. 5.

During the sustain period, in order to prevent the charges on the back glass substrate, address electrodes A are biased with a positive potential; next, at first, a first positive sustain pulse Ps having a peak value Vs is applied to all second sustain electrodes Y3.

Subsequently, the application of second sustain pulses Psx to first sustain electrodes X3 and first sustain pulses Ps to the second sustain electrodes Y3 is alternately repeated. Upon each application of the both sustain pulses Psx or Ps, the surface discharge, i.e. the sustain discharge, takes place at a cell having the predetermined wall charges accumulated, so as to reverse the polarity of the wall charges.

Here, the pulse to cause a sustain discharge in which the second sustain electrode Y3 is the cathode, that is the second sustain pulse Psx is applied to the first sustain electrode X3, is a positive pulse having the peak value V3 similarly to first sustain pulse ps. However, the rise of the second sustain pulse Psx is more gradual than that of first sustain pulse Ps.

The ion bombardment onto the portion of dielectric layer 17 covering the second sustain electrode Y3 can be eased by thus intentionally slowing the rise of the waveform of the second sustain pulse Psx, as explained later in detail.

In FIGS. 12A and 12B are shown voltage waveforms applied to the cells during the sustain period, i.e., the cell voltage, which may be sometimes called an effective voltage. In FIG. 12A is shown an example of the first sustain pulse Ps applied to second sustain electrodes Y3. In FIG. 12B is shown an example of second sustain pulse Psx applied to first sustain electrode X3.

At this time, the sustain electrodes to which no voltage is applied are kept at 0 V.

In FIG. 12A, cell voltage Veff between the pair of sustain electrodes X3 & Y3 is added to wall voltage Vwall by the application of first sustain pulse Ps, accordingly rises rapidly and exceeds a surface discharge firing potential VfXY. The rise time is about tens of nano seconds.

Meanwhile, a charging current flows into the cells. Surface discharge takes place at a time delayed from the rise of the first sustain pulse Ps. At this time, the discharge is comparatively strong because the cell voltage has already reached its maximum value. Wall charges of the opposite polarity are accumulated by this discharge, whereby cell voltage Veff is decreased and the polarity is finally reversed.

On the other hand, in applying the second sustain pulse Psx, the cell voltage Veff rises gradually from the wall voltage Vwall as shown in FIG. 12B. The surface discharge takes place delayed to a time behind the moment at which cell voltage Veff exceeds surface discharge firing potential VfXY. In this case, the discharge is weaker than the ease of the steep first sustain pulse Ps application because the surface discharge takes place before cell voltage Veff reaches its maximum value.

In FIG. 13 is schematically illustrated a case where a driving circuit is formed with semiconductor switches. The bias potential of the first and second sustain electrodes X3 & Y3 is switched between the ground potential and sustain voltage Vs respectively by first and second switching circuits 110 and 120. A switching control signal is input to both the switching circuits 110 & 120 from a controller, which is not shown in the figure.

Second sustain electrode Y3 is connected directly to the output terminal of second switching circuit 120.

On the other hand, first sustain electrode X3 is connected to an output terminal of the first switching circuit 110 via a resistor 115 of 100 Ω, for example. Accordingly, the time constant determined by resistor 115 and stray capacity Cs of first sustain electrode X3 is increased, whereby the rise of second sustain pulse Psx applied to first sustain electrode X3 is more gradual than the rise of first sustain pulse Ps.

The sustain discharge by second sustain pulse Psx starts in about 0.6 μs, while the sustain discharge by first sustain pulse Ps reached the peak already in about 0.6 μs.

Owing to the more feasible address discharge achieved by shifting the second sustain electrode Y3 closer to the discharge space 303, the space size of discharge space 303, that is the height of separator walls 29, can be increased more than in the above-described fifth preferred embodiment.

In this case, though it is necessary to apply the same degree of the voltage as the prior art in causing the address discharge, the brightness as well as the luminous efficiency can be improved while improving the degree of design freedom because the coated area of fluorescent layer 28 can be widened so much as the surface discharge can easily spread and the height of separator walls 29 increases.

Deterioration of the electrode protecting layer covering the sustain electrodes can be prevented by the employment of the driving method of the third preferred embodiment.

By the employment of the above-described invention, the address discharge which can take place in the vicinity to the discharge gap of the sustain electrode pair allows the effective accumulation of the wall charge. Therefore, the wall charges necessary in the sustaining operation can be secured so as to achieve a high-speed display having no erroneous operation even if the address period is shortened.

Moreover, a miss-lighting on the adjacent lines can be prevented.

Though PDPs 1 to 4 referred to in the above-described preferred embodiments have the constitution such that the address electrodes are arranged on the inner surface or back glass substrate 21 & 214, it is apparent that the present invention can be embodied in a PDP or the constitution such that the address electrodes and the sustain electrodes are on a common substrate.

The many features and advantages or the invention are apparent from the detailed specification and, thus, it is intended by the appended claims to cover all such features and advantages of the methods which fall within the true spirit and scope of the invention. Further, since numerous modifications and changes will readily occur to those skilled in the art, it is not intended to limit the invention and, accordingly, all suitable modifications and equivalents may be resorted to, failing within the scope of the invention.

What is claimed is:

1. An AC type plasma display panel, comprising:

first and second sustain electrodes, extending in parallel along a line direction and being spaced apart, in a second direction perpendicular to the line direction, and defining a discharge slit therebetween;

a discharge space;

a dielectric layer coated on the first and second sustain electrodes so as to insulate the first and second sustain electrodes from the discharge space, a discharge for lighting being generated along a surface of said dielectric layer in the direct vicinity of the slit;

an address electrode crossing and opposing the first and second sustain electrodes and separated therefrom via the dielectric layer and the discharge space;

the first sustain electrode comprising an elongated first transparent electrode having a first edge adjacent to, and a second edge remote from, the discharge slit and a first elongated metal electrode of a narrower width than a width of said first transparent electrode and disposed thereon with a first edge facing the discharge slit but displaced in the second direction from the discharge slit and the first edge of the first sustain electrode and a second edge remote from the discharge slit and adjacent to the second edge of the first sustain electrode; and the second sustain electrode comprising an elongated second transparent electrode having a first edge adjacent to, and a second edge remote from, the discharge slit and an elongated second metal electrode of a narrower width than a width of said second transparent electrode and disposed thereon with a first edge facing the discharge slit and adjacent to the discharge slit and the first edge of the second transparent electrode and a second edge remote from the discharge slit and displaced in the second direction from the second edge of the second transparent electrode.

2. The plasma display panel as recited in claim 1, wherein said width of said second metal electrode is greater than said width of said first metal electrode.

3. The plasma display panel as recited in claim 1, wherein a distance between said second sustain electrode and said address electrode is smaller than a distance between said first sustain electrode and said address electrode.

4. A method of driving a plasma display panel, comprising the steps of:

providing a plasma display panel having first and second sustain electrodes, extending in parallel along a line direction and being spaced apart, in a second direction perpendicular to the line direction, and defining a discharge slit therebetween, a discharge space, a dielectric layer coated on the first and second sustain electrodes so as to insulate the first and second sustain electrodes from the discharge space, a discharge for lighting being generated along a surface of said dielectric layer in the direct vicinity of the slit, an address electrode crossing and opposing the first and second sustain electrodes and separated therefrom via the dielectric layer and the discharge space, the first sustain electrode comprising an elongated first transparent electrode having a first edge adjacent to, and a second edge remote from, the discharge slit and a first elongated metal electrode of a narrower width than a width of said first transparent electrode and disposed thereon with a first edge facing the discharge slit but displaced in the second direction from the discharge slit and the first edge of the first sustain electrode and a second edge remote from the discharge slit and adjacent to the second edge of the first sustain electrode, and the second sustain electrode comprising an elongated second transparent electrode having a first edge adjacent to, and a second edge remote from, the discharge slit and an elongated second metal electrode of a narrower width than a width of said second transparent electrode and disposed thereon with a first edge facing the discharge slit and adjacent to the discharge slit and the first edge of the second transparent electrode and a second edge remote from the discharge slit and displaced in the second direction from the second edge of the second transparent electrode;

generating a first discharge between said address electrode and said second sustain electrode so as to accumulate electric charges on said dielectric layer; and causing a second discharge between said first and second sustain electrodes by the utilization of said accumulated electric charges.

5. A plasma display panel, comprising:

a first sustain electrode extending in a line direction;

a second sustain electrode extending in parallel to the first sustain electrode and spaced therefrom in a second direction perpendicular to the line direction via a discharge slit;

a discharge space;

a dielectric layer coated on the first and second sustain electrodes so as to insulate the first and second sustain electrodes from the discharge space;

an address electrode crossing and opposing the first and second sustain electrodes, separated therefrom via the dielectric layer and the discharge space;

the first sustain electrode comprises an elongated first transparent electrode having a first edge adjacent to, and a second edge remote from, the discharge slit and a first elongated metal electrode of a narrower width than a width of the first transparent electrode and disposed thereon with a first edge facing the discharge slit but displaced in the second direction from the discharge slit and the first edge of the first sustain electrode and a second edge remote from the discharge slit and adjacent to the second edge of the first sustain electrode; and the second sustain electrode comprises solely a second elongated metal electrode.

6. A method of driving a plasma display panel, comprising the steps of:

providing a plasma display panel comprising a first sustain electrode extending in a line direction, a second sustain electrode extending in parallel to the first sustain electrode and spaced therefrom in a second direction perpendicular to the line direction via a discharge slit, a discharge space, a dielectric layer coated on the first and second sustain electrodes so as to insulate the first and second sustain electrodes from the discharge space, an address electrode crossing and opposing the first and second sustain electrodes and separated therefrom via the dielectric layer and the discharge space, the first sustain electrode comprising an elongated first transparent electrode having a first edge adjacent to, and a second edge remote from, the discharge slit and a first elongated metal electrode of a narrower width than a width of the first transparent electrode and disposed thereon with a first edge facing the discharge slit but displaced in the second direction from the discharge slit and the first edge of the first sustain electrode and a second edge remote from the discharge slit and adjacent to the second edge of the first sustain electrode, the second sustain electrode comprising solely a second elongated metal electrode;

generating a first discharge between the address electrode and the second sustain electrode so as to accumulate electric charges on the dielectric layer; and causing a second discharge between the first and second electrodes by the utilization of the accumulated electric charges.

7. A method of driving an AC type plasma display panel, comprising:

providing a plasma display panel having first and second sustain electrodes, extending in parallel along a line direction and being spaced apart, in a second direction perpendicular to the line direction, and defining a discharge slit therebetween, a discharge space, a dielectric layer coated on the first and second sustain electrodes so as to insulate the first and second sustain electrodes from the discharge space, a discharge for lighting being generated along a surface of said dielectric layer in the direct vicinity of the slit, an address electrode crossing and opposing the first and second sustain electrodes and separated therefrom via the dielectric layer and the discharge space, the first sustain electrode comprising an elongated first transparent electrode having a first edge adjacent to, and a second edge remote from, the discharge slit and a first elongated metal electrode of a narrower width than a width of said first transparent electrode and disposed thereon with a first edge facing the discharge slit but displaced in the second direction from the discharge slit and the first edge of the first sustain electrode and a second edge remote from the discharge slit and adjacent to the second edge of the first sustain electrode, and the second sustain electrode comprising an elongated second transparent electrode having a first edge adjacent to, and a second edge remote from, the discharge slit and an elongated second metal electrode of a narrower width than a width of said second transparent electrode and disposed thereon with a first edge facing the discharge slit and adjacent to the discharge slit and the first edge of the second transparent electrode and a second edge remote from the discharge slit and displaced in the second direction from the second edge of the second transparent electrode;

during a sustain period, applying first and second pulses of a common polarity alternately to the first sustain electrode and to the second sustain electrode, respectively, so as to cyclically generate discharges between the first and second sustain electrodes, the first pulse making the second sustain electrode negative with respect to the first sustain electrode and the second pulse making the second sustain electrode positive with respect to the first sustain electrode; and controlling a first rise time of the first pulse, to be slower than a second rise time of the second pulse.

8. A three electrode type AC plasma display panel, comprising:

a plurality of pairs of parallel sustain electrodes, each pair of parallel sustain electrodes producing corresponding surface discharges therebetween and defining a center line thereof relative to the corresponding pair of sustaining electrodes, each of the sustain electrodes being formed of a multiple layer structure of an elongated transparent conductive film and an elongated metal film associated with the transparent conductive film and having a narrower width than a width of the associated transparent conductive film;

address electrodes producing address discharges and disposed in crossing relationship relative to the sustain electrodes; and each of said metal films is arranged at an asymmetric distance in a direction transverse to the parallel sustain electrodes from the center line of the corresponding surface discharges of the associated pair of sustain electrodes.

9. The plasma display panel as recited in claim 2, wherein a distance between said second sustain electrode and said address electrode is smaller than a distance between said first sustain electrode and said address electrode.

10. The method of driving a plasma display panel as recited in claim 4, wherein the providing step further comprises providing a plasma display panel in which the width of the second metal electrode is greater than the width of the first metal electrode.

11. The method of driving a plasma display panel as recited in claim 4, wherein the providing step further comprises providing a plasma display panel in which a distance between said second sustain electrode and said address electrode is smaller than a distance between said first sustain electrode and said address electrode.

12. An AC type plasma display panel, comprising:

a plurality of pairs of respective first and second sustain electrodes extending in a line direction, the first and second sustain electrodes of each pair being spaced apart by a discharge slit and each second sustain electrode being narrower than the first sustain electrode;

a discharge space;

a dielectric layer coated on the first and second sustain electrodes so as to insulate the first and second sustain electrodes from the discharge space, a discharge for lighting being generated along a surface of said dielectric layer in the direct vicinity of the discharge slit; and a plurality of address electrodes extending in a crossing relationship to, and spaced from and opposing, the first and second sustain electrodes via the dielectric layer and the discharge space.

13. The plasma display panel as recited in claim 12, wherein:

said first sustain electrode comprises a first transparent electrode and a first metal electrode of narrower width than a width of said first transparent electrode and disposed thereon; and said second sustain electrode comprises solely a metal electrode of narrower width than the width of said first transparent electrode.

14. The plasma display panel as recited in claim 12, wherein a distance between said second sustain electrode and said address electrode is smaller than a distance between said first sustain electrode and said address electrode.

15. The method of driving a plasma display panel as recited in claim 12, comprising:

providing a plasma display panel having a plurality of pairs of respective first and second sustain electrodes extending in a line direction, each pair of first and second sustain electrodes being spaced apart by a discharge slit and each second sustain electrode being narrower than the first sustain electrode, a discharge space, a dielectric layer coated on the first and second sustain electrodes so as to insulate the first and second sustain electrodes from the discharge space, a discharge for lighting being generated along a surface of said dielectric layer in the direct vicinity of the discharge slit, and a plurality of address electrodes extending in a crossing relationship to and opposing the first and second sustain electrodes and spaced therefrom, via the dielectric layer and the discharge space;

generating a first discharge between said address electrode and said second sustain electrode so as to accumulate electric charges on said dielectric layer, and causing a second discharge between said first and second sustain electrodes by the utilization of said accumulated electric charges.

16. The method of driving a plasma display panel as recited in claim 15, wherein the providing step further comprises providing a plasma display panel in which said first sustain electrode comprises a first transparent electrode and a first metal electrode of narrower width than a width of said first transparent electrode and disposed thereon, and said second sustain electrode comprises solely a metal electrode of narrower width than the width of said first transparent electrode.

17. The method of driving a plasma display panel as recited in claim 15, wherein the providing step further comprises providing a plasma display panel in which a distance between said second sustain electrode and said address electrode is smaller than a distance between said first sustain electrode and said address electrode.

18. A three-electrode type AC plasma display panel, comprising:

first and second substrates in opposing relationship and defining a discharge space therebetween;

a plurality of pairs of first and second sustain electrodes on said first substrate, the first and second sustain electrodes of each pair having respective, adjacent edges thereof spaced via a discharge slit enabling a surface discharge therebetween, and respective, remote edges thereof being spaced from a center line of the discharge slit by first and second distances, the first distance greater than the second distance, each said sustain electrode pair being spaced from an adjacent sustain electrode pair via a reverse slit at which no discharge takes place;

a plurality of address electrodes arranged on said second substrate, crossing said sustain electrodes and in opposing, spaced relationship with respect thereto, unit luminous areas being defined at corresponding cross points of said sustain electrode pairs and said address electrodes; and an address discharge, for selecting each unit luminous area to be lit, being generated between said address electrode and said second sustain electrode.

19. A three-electrode type AC plasma display panel recited in claim 18, further comprising:

a plurality of separator walls, disposed between corresponding said address electrodes on said second substrate and partitioning said discharge space.

20. A three-electrode type AC plasma display panel comprising:

a pair of first and second sustain electrodes forming a discharge pair, said first sustain electrode having a width narrower than a width of said second sustain electrode;

an address electrode crossing said first and second sustain electrodes and defining therewith a unit lighting area; and an address discharge being generated between said first sustain electrode and said address electrode so as to produce selective lighting of the unit lighting area, whereby sustain discharge is generated between said first and second sustain electrodes so as to sustain a lighted state of said unit lighting area.

21. A three-electrode type AC plasma display panel, comprising:

first and second substrates defining a discharge space therebetween;

a plurality of pairs of first and second sustain electrodes on said first substrate, the first and second sustain electrodes of each pair of having respective, adjacent edges thereof spaced via a discharge slit enabling a surface discharge therebetween, and respective, remote edges thereof being spaced from a center line of the discharge slit by first and second distances, the first distance greater than the second distance, each said sustain electrode pair being spaced from an adjacent sustain electrode pair via a reverse slit at which no discharge takes place;

a plurality of address electrodes arranged on said second substrate, crossing said sustain electrodes and in opposing, spaced relationship with respect thereto, a unit luminous area being defined at each cross point of a sustain electrode pair and an address electrode; and an address discharge being generated between said address electrode and said second sustain electrode.

22. A three-electrode type AC plasma display panel in claim 21, further comprising:

a plurality of separator walls, disposed between corresponding said address electrodes on said second substrate and partitioning said discharge space.

23. A three-electrode type AC display panel comprising:

a pair of first and second sustain electrodes forming a discharge pair, said first sustain electrode having a width narrower than a width of said second sustain electrode;

an address electrode crossing said first and second sustain electrodes and defining therewith a unit lighting area; and an addressing discharge being generated between said first sustain electrode and said address electrode so as to select one on/off states of the unit lighting area, whereby a sustain discharge generated between said first and second sustain electrodes sustains an on state of said unit lighting area.

* * * * *